US007927459B2

(12) United States Patent
Huang et al.

(10) Patent No.: US 7,927,459 B2
(45) Date of Patent: Apr. 19, 2011

(54) METHODS FOR IMPROVING THE TEAR STRENGTH OF MATS

(75) Inventors: Helen Y. Huang, New Albany, OH (US); Paul Klett, Newawrk, OH (US); Liang Chen, New Albany, OH (US); Timothy A. Miller, Newark, OH (US); Timothy R. Gilbert, Granville, OH (US)

(73) Assignee: OCV Intellectual Capital, LLC, Toledo, OH (US)

( * ) Notice: Subject to any disclaimer, the term of this patent is extended or adjusted under 35 U.S.C. 154(b) by 705 days.

(21) Appl. No.: 11/901,402

(22) Filed: Sep. 17, 2007

(65) Prior Publication Data

US 2009/0071617 A1 Mar. 19, 2009

(51) Int. Cl.
*D21H 17/33* (2006.01)
*D21H 23/12* (2006.01)
*D21H 23/14* (2006.01)

(52) U.S. Cl. ..... 162/156; 162/152; 162/158; 162/164.1; 162/168.1; 162/185

(58) Field of Classification Search ..... None
See application file for complete search history.

(56) References Cited

U.S. PATENT DOCUMENTS 4,147,833 A 4/1979 Eilerman et al.
4,178,203 A 12/1979 Chakrabarti
4,190,566 A 2/1980 Noll et al.
4,255,485 A * 3/1981 Yau ..... 442/331
4,258,098 A 3/1981 Bondoc
4,271,229 A 6/1981 Temple
4,359,546 A 11/1982 Bershas
4,394,475 A 7/1983 Temple et al.
4,461,804 A 7/1984 Motsinger et al.

(Continued)

FOREIGN PATENT DOCUMENTS

EP 1584724 10/2005

(Continued)

OTHER PUBLICATIONS

Machine translation of FR 2250719, The European Patent Office, [online], [retrieved on Aug. 10, 2010]. Retrieved from the Internet: <URL: http://ep.espacenet.com/?locale=EN_ep>.*

(Continued)

*Primary Examiner* — Matthew J Daniels
*Assistant Examiner* — Dennis Cordray
(74) *Attorney, Agent, or Firm* — Calfee, Halter & Griswold LLP

(57) ABSTRACT

Methods for improving the tear strength in non-woven chopped strand mats during the manufacturing process of the mats are provided. In particular, the tear strength of the mat can be improved as the mat is being formed in response to current manufacturing conditions by the addition of a water soluble polyol, such as polyvinyl alcohol, or a cationic dispersant to the binder seal pit. Alternatively, a cationic dispersant may be added to the white water chest to improve the tear strength of the chopped strand mat. The addition of polyvinyl alcohol or a cationic dispersant to the binder seal pit results in an immediate or nearly immediate improvement of the tear strength of the chopped strand mat. Both the polyvinyl alcohol and the cationic dispersant can be utilized to improve the tear strength of a chopped strand mat regardless of the type of binder or components in the white water.

20 Claims, 9 Drawing Sheets

U.S. PATENT DOCUMENTS

| | | | | |
|---|---|---|---|---|
| 4,526,914 | A * | 7/1985 | Dolin | 524/42 |
| 4,536,446 | A * | 8/1985 | Hsu et al. | 428/392 |
| 4,542,065 | A | 9/1985 | Gaa | |
| 4,542,068 | A | 9/1985 | Whichard | |
| 4,546,880 | A | 10/1985 | Reese | |
| 4,567,228 | A | 1/1986 | Gaa et al. | |
| 4,582,873 | A | 4/1986 | Gaa et al. | |
| 4,592,956 | A | 6/1986 | Gaa et al. | |
| 4,681,658 | A | 7/1987 | Hsu et al. | |
| 4,681,802 | A | 7/1987 | Gaa et al. | |
| 4,745,028 | A | 5/1988 | Das et al. | |
| 4,762,750 | A | 8/1988 | Girgis et al. | |
| 4,795,678 | A | 1/1989 | Girgis | |
| 4,810,576 | A | 3/1989 | Gaa et al. | |
| 5,041,494 | A | 8/1991 | Franke et al. | |
| 5,445,878 | A * | 8/1995 | Mirous | 442/327 |
| 5,554,686 | A | 9/1996 | Frisch, Jr. et al. | |
| 5,646,207 | A | 7/1997 | Schell | |
| 5,667,058 | A | 9/1997 | Bonnet | |
| 5,773,146 | A | 6/1998 | Lawton et al. | |
| 5,804,313 | A | 9/1998 | Schell | |
| 5,851,933 | A | 12/1998 | Swartz | |
| 6,034,006 | A * | 3/2000 | Arpin et al. | 442/173 |
| 6,179,962 | B1 | 1/2001 | Brady | |
| 6,384,116 | B1 * | 5/2002 | Chan et al. | 524/186 |
| 6,544,911 | B2 | 4/2003 | Peng et al. | |
| 6,642,299 | B2 * | 11/2003 | Wertz et al. | 524/512 |
| 6,706,147 | B2 | 3/2004 | Peng et al. | |
| 6,770,169 | B1 * | 8/2004 | Wallace | 162/156 |
| 6,817,152 | B2 | 11/2004 | Peng et al. | |
| 6,864,340 | B2 | 3/2005 | Levandoski et al. | |
| 2002/0144522 | A1 * | 10/2002 | Messick et al. | 65/477 |
| 2002/0198301 | A1 | 12/2002 | Campbell et al. | |
| 2005/0136237 | A1 | 6/2005 | Beerda et al. | |
| 2005/0276960 | A1 * | 12/2005 | Lee et al. | 428/292.1 |
| 2005/0282451 | A1 * | 12/2005 | Canfield et al. | 442/59 |
| 2006/0113050 | A1 | 6/2006 | Droux et al. | |
| 2006/0204737 | A1 | 9/2006 | Ziegler | |
| 2007/0006775 | A1 | 1/2007 | Helwig et al. | |
| 2007/0039703 | A1 | 2/2007 | Lee et al. | |
| 2007/0059506 | A1 | 3/2007 | Hager et al. | |

FOREIGN PATENT DOCUMENTS

| | | | |
|---|---|---|---|
| FR | 2250719 | A * | 5/1975 |
| WO | WO 94/13473 | | 6/1994 |
| WO | WO 98/34885 | | 8/1998 |
| WO | WO 2007/024683 | | 3/2007 |
| WO | 2008/150944 | | 12/2008 |

OTHER PUBLICATIONS

Subramani et al. "Synthesis and Characterization of Water-borne Crosslinked Silyated Polyurethane Dispersions" Journal of Applied Polymer Science, Jul. 26, 2005, pp. 620-631, vol. 98, Issue 2, Wiley Periodicals, Inc.

Subramani et al. "Synthesis and Characterization of Silyated Polyurethane from Methyle Ethyl Ketoxime-Blocked Polyurethane Dispersion" Feb. 11, 2004.

PCT International Search Report PCT/US2008/077672 dated Mar. 31, 2009.

Office action from U.S. Appl. No. 11/809,501 dated Nov. 9, 2009.

Office action from U.S. Appl. No. 11/809,501 dated Jul. 14, 2010.

International Search Report and Written Opinion from PCT/US08/065196 dated Dec. 10, 2008.

Office action from U.S. Appl. No. 11/809,501 dated Nov. 23, 2010.

* cited by examiner

METHODS FOR IMPROVING THE TEAR STRENGTH OF MATS

TECHNICAL FIELD AND INDUSTRIAL APPLICABILITY OF THE INVENTION

The present invention relates generally to non-woven fibrous mats, and more particularly, to methods for improving the tear strength of a wet-laid chopped strand mat by adding a water-soluble polyol or a cationic dispersant to the binder seal pit or a cationic dispersant to the white water chest during the manufacturing of the chopped strand mat.

BACKGROUND OF THE INVENTION

Typically, glass fibers are formed by drawing molten glass into filaments through a bushing or orifice plate and applying an aqueous sizing composition containing lubricants, coupling agents, and film-forming binder resins to the filaments. The sizing composition provides protection to the fibers from interfilament abrasion and promotes compatibility between the glass fibers and the matrix in which the glass fibers are to be used. After the sizing composition is applied, the wet filaments may be gathered into one or more strands, chopped, and collected. The chopped strands may contain hundreds or thousands of individual glass fibers. The collected chopped glass strands may then be packaged in their wet condition as wet use chopped strands (WUCS) or dried to form dry use chopped strands (DUCS).

Wet chopped strands are conventionally used in wet-laid processes in which the wet chopped fibers forming the wet chopped strands are dispersed in a water slurry that contains surfactants, viscosity modifiers, defoaming agents, and/or other chemical agents. The slurry containing the chopped fibers is then agitated so that the fibers become dispersed throughout the slurry. The slurry containing the fibers is deposited onto a moving screen where a substantial portion of the water is removed to form a web. A binder is applied, and the resulting mat is dried to remove any remaining water and cure the binder. The formed non-woven mat is an assembly of dispersed, individual glass fibers.

Fibrous mats formed by wet-laid processes are extremely suitable as reinforcements for many types of applications. For example, wet-laid mats may be used in roofing applications, non-woven veil applications, or to form composite laminates or ceiling tiles. Because the fibers are not dried prior to use, wet-laid mats provide a lower cost alternative to dry-laid mats. Besides their economic advantage, wet-laid mats have the attributes of good wettability for impregnation by plastic resins, quick air releasing capacity, and superior surface characteristics. In addition, they serve well as spacing and core material.

Although wet-laid mats possess many desirable attributes, attempts are continually being made to improve conventional chopped strand mats. One particular area of interest is improving the tear and tensile strengths of the mats, as these properties are consumer-oriented and consumer-driven. Some examples of attempts to improve chopped strand mats are set forth below.

U.S. Pat. No. 6,179,962 to Brady, et al. discloses a process for making paper that adds the combination of a water soluble and/or water dispersible cationic polymer and an oxidized galactose type of alcohol configuration containing polymer to the pulp water. The oxidized galactose type of alcohol configuration may contain polymers such as neutral, anionic, and/or amphoteric oxidized guar. Oxidized guar is preferred as the oxidized galactose type of alcohol. It is asserted that the water soluble and/or water dispersible cationic polymer and the oxidized galactose type of alcohol configuration containing polymer can be added at anywhere in the process of papermaking, including the white water chest. The process is asserted to improve the paper strength.

U.S. Pat. No. 6,642,299 to Wertz, et al. teaches an adhesive aqueous binder composition that contains a urea-formaldehyde resin modified with an additive that includes (1) styrene acrylic acid or styrene acrylate, (2) an adduct of styrene, maleic anhydride, and an acrylic acid or acrylate, or (3) a physical mixture of a styrene-maleic anhydride copolymer. The adduct can be preformed and then added to the urea-formaldehyde resin, or it can be formed in situ in the binder resin by blending, with the urea-formaldehyde resin, a physical mixture of styrene-maleic anhydride and an acrylate monomer. The modified binder is used to prepare fiber mats that assertedly have improved wet and dry tensile properties. The mats may be formed by a white water process.

Although conventional wet-laid mats are continually being improved, there remains a need in the art for a method for improving the tear strength of chopped strand mats, especially during the manufacture of the chopped strand mats.

SUMMARY OF THE INVENTION

It is an object of the present invention to provide a method for improving the tear strength of chopped strand glass mats in-line that includes forming a chopped strand mat by a wet-laid process and spiking the binder seal pit with a water-soluble polyol such as polyvinyl alcohol, glycerin, ethylene glycol, and/or butyl diol. The water-soluble polyol may be added to the binder seal pit in an amount sufficient to achieve a concentration of the water-soluble polyol in the binder seal pit from about 200 to about 4000 ppm. The addition of a water-soluble polyol to the binder seal pit is particularly advantageous because only a small amount of polyol is added to achieve a desired improvement in tear strength. Also, the addition of a water-soluble polyol improves the tear strength of the chopped strand mat without the addition of other chemicals or additives. The water soluble polyol is added to the binder seal pit as needed to improve or adjust the tear strength of the chopped strand mat in response to current manufacturing conditions. This ability to monitor and adjust the tear strength of the glass mat in-line creates manufacturing flexibility.

It is also an object of the present invention to provide a method of adjusting the tear strength of a chopped strand mat during the manufacture of the mat where the method includes (1) determining an initial tear strength of a chopped strand mat being formed in a wet-laid process, and (2) adding one or more cationic dispersants to the binder seal pit if the initial tear strength is below a predetermined value. The cationic dispersant may be one or more tallow amine dispersants, ethoxylated alkylamine dispersants, fatty acid esters, polyethylene glycol, cationic quaternary amine, amine oxides, and/or a polyethyoxylated derivative of an amide condensated fatty acid. The cationic dispersant(s) may be added to the binder seal pit in an amount sufficient to achieve a concentration of the cationic dispersant in the binder seal pit from about 200 to about 4000 ppm, preferably from about 1000 to about 2000 ppm. In addition, the cationic dispersant improves the tear strength of the chopped strand mat without the addition of other chemicals or additives. The cationic dispersant may be added at any time during the manufacturing process as needed. As a result, the method provides for an on-going, in-line adjustment (e.g., improvement) of the tear strength of the chopped strand mat.

It is also an object of the present invention to provide a method for improving the tear strength of a chopped strand mat in-line that includes forming a chopped fiber slurry in a white water tank, depositing the chopped fiber slurry on a conveyor to form a web of enmeshed fibers, applying a binder to the web, removing excess water from the web, curing the binder to form a chopped strand mat, determining an initial tear strength of the chopped strand mat, and spiking the white water tank with at least one cationic dispersant if the initial tear strength is below a predetermined value. The addition of the cationic dispersant improves the tear strength of the mat without a negative impact on mat tensile strength, hot wet tensile retention, or mat formation. Additionally, the cationic dispersant can be utilized to improve the tear strength of a chopped strand mat regardless of the type of binder or the white water components. The cationic dispersant may be added in an amount sufficient to achieve a concentration from about 800 to about 1600 ppm of cationic dispersant within the white water chest. In exemplary embodiments of the invention, the cationic dispersant(s) is selected from tallow amine dispersants, ethoxylated alkylamine dispersants, fatty acid esters, polyethylene glycol, cationic quaternary amine, amine oxides, and/or a polyethyoxylated derivative of an amide condensated fatty acid.

It is an advantage of the present invention that spiking the binder seal pit with a water-soluble polyol such as polyvinyl alcohol improves the tear strength of the glass mat without detrimentally affecting the tensile strength of the mat.

It is another advantage of the present invention that spiking the binder seal pit with a cationic dispersant improves the glass mat tear strength.

It is yet another advantage of the present invention that the improvement in the tear strength caused by the addition of a water-soluble polyol (e.g., polyvinyl alcohol) to the binder seal pit is immediate or nearly immediate.

It is also an advantage of the present invention that spiking the white water chest with a cationic dispersant improves the tear strength of the glass mat without having a negative impact on the tensile strength or hot wet tensile retention of the mat.

It is a further advantage of the present invention that the water-soluble polyol or cationic dispersant can be added at any time during the manufacture of the glass mat.

It is yet another advantage of the present invention that only a small amount of water-soluble polyol or cationic dispersant is necessary to achieve an improvement in the tear strength of the glass mat when added to the binder seal pit.

It is also an advantage of the present invention that the tear strength of the mat can be improved as the mat is being formed in response to current manufacturing conditions.

It is a feature of the present invention that the polyvinyl alcohol and the cationic dispersant can be utilized to improve the tear strength of a chopped strand mat regardless of the type of binder or the components present in the white water.

It is another feature of the present invention that the water soluble polyol (e.g., polyvinyl alcohol) and the cationic dispersant each improves the tear strength of the chopped strand mat without the addition of any other chemicals.

The foregoing and other objects, features, and advantages of the invention will appear more fully hereinafter from a consideration of the detailed description that follows. It is to be expressly understood, however, that the drawings are for illustrative purposes and are not to be construed as defining the limits of the invention.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION AND PREFERRED EMBODIMENTS OF THE INVENTION

Figure 1:
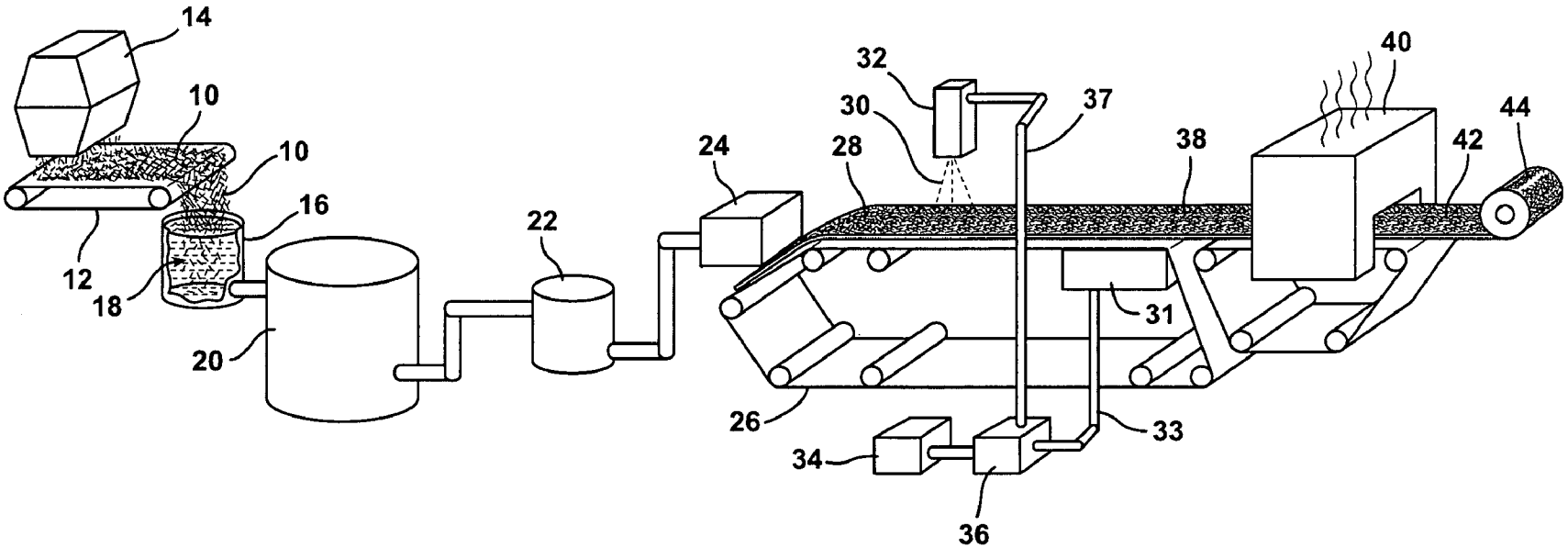
FIG. 1 is a schematic illustration of a processing line for forming a chopped strand mat utilizing a wet-laid process according to at least one exemplary embodiment of the present invention.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references cited herein, including published or corresponding U.S. or foreign patent applications, issued U.S. or foreign patents, or any other references, are each incorporated by reference in their entireties, including all data, tables, figures, and text presented in the cited references.

In the drawings, the thickness of the lines, layers, and regions may be exaggerated for clarity. It is to be noted that like numbers found throughout the figures denote like elements. It will be understood that when an element is referred to as being "on," another element, it can be directly on or against the other element, or intervening elements may be present. The terms "fiber" and "filament" may be used interchangeably herein.

The present invention is directed to methods for improving the tear strength in non-woven chopped strand mats during the manufacturing process of the mat. In particular, it has been discovered that the addition of a water-soluble polymer such as polyvinyl alcohol to a binder seal pit or the addition of a cationic dispersant to the binder seal pit or white water chest improves the tear strength of a non-woven chopped strand mat. The water-soluble polyol or the cationic dispersant may be added at any time during the mat manufacturing process to adjust or improve the tear strength of the chopped strand mat. In addition, the water-soluble polyol (e.g., polyvinyl alcohol) and the cationic dispersant improve the tear strength of chopped strand mats without the addition of any other chemicals or additives. Spiking the binder seal pit with polyvinyl alcohol or a cationic dispersant results in an immediate or nearly immediate improvement in the tear strength of the non-woven mat.

A non-woven chopped strand mat (e.g., a roofing mat) may be formed by a wet-laid process as depicted in FIG. 1. Chopped fiber strands 10 may be provided to a conveyor 12 from a storage container 14. The chopped fiber strands 10 are formed of a plurality of individual reinforcement fibers positioned in a substantially parallel orientation to each other in a tight knit or "bundled" formation. As used herein, the phrase "substantially parallel" is meant to denote that the individual reinforcement fibers are parallel or nearly parallel to each other. The reinforcement fibers used to form the chopped fiber strands 10 may be any type of glass fiber, such as A-type glass fibers, C-type glass fibers, E-type glass fibers, S-type glass fibers, ECR-type glass fibers (e.g., Advantex® glass fibers commercially available from Owens Corning), wool glass fibers, or combinations thereof. In at least one preferred embodiment, the glass fibers are wet use chopped strand glass fibers (WUCS). Wet use chopped strand glass fibers may be formed by conventional processes known in the art. It is desirable that the wet use chopped strand glass fibers have a moisture content from about 5 to about 30%, and even more desirably, have a moisture content from about 5 to about 15%.

Wet use chopped strand glass fibers are a low cost reinforcement that provides impact resistance, dimensional stability, and improved mechanical properties such as improved strength and stiffness to the finished product. In addition, with WUCS, the final product possesses the mechanical properties to take nails and screws in construction processes without cracking or other mechanical failures. Further, WUCS fibers are easily mixed and may be fully dispersed or nearly fully dispersed in the white water of a wet-laid process.

Alternatively, the reinforcing fiber may be fibers of one or more synthetic polymers such as polyester, polyamide, aramid, and mixtures thereof. The polymer strands may be used alone as the reinforcing fiber material, or they can be used in combination with glass fibers such as those described above. The inclusion of synthetic fibers in the chopped strands 10 may give a mat formed with the chopped synthetic fibers more flexibility. In addition, the use of synthetic fibers may act as a mat binder in later processing to hold the chopped fiber strands 10 together and form a chopped strand mat. However, it is preferred that all of the fibers in the chopped strands 10 are glass fibers.

Additionally, the chopped strands 10 may include fibers that have a diameter from about 5.0 microns to about 30.0 microns and may be cut into segments having a discrete length of approximately 5.0 mm to about 50.0 mm in length. Preferably, the fibers have a diameter from about 10.0 microns to about 20.0 microns and a length from about 20 mm to about 35 mm. If the chopped strands 10 are wet use chopped strand glass (WUCS), they may have a length from about ⅛ of an inch to about 4 inches, and preferably have a length from about ½ of an inch to about 1.5 inches. Each chopped strand 10 may contain from approximately 500 fibers to approximately 8,000 fibers.

Although any or a combination of the reinforcing fibers described herein may be used to form a chopped strand mat, it is to be noted that the processes described herein are described with respect to a preferred embodiment in which the reinforcement fibers in the chopped strands 10 are glass fibers. As shown in FIG. 1, the chopped glass fiber strands 10 are placed into a white water chest 16 that contains various surfactants, viscosity modifiers, defoaming agents, lubricants, biocides, and/or other chemical agents with agitation to form a chopped glass fiber slurry 18 in which the glass fibers released from the chopped glass fiber strands 10 are dispersed. It is desirable that the slurry 18 is agitated sufficiently to provide a uniform or nearly uniform dispersion of glass fibers. The white water may have a viscosity from about 1 to 20 cps, although it is to be appreciated that the viscosity is ultimately dependent upon the process parameters of the wet-laid process.

The slurry 18 may be passed through a machine chest 20 and a constant level chest 22 to further disperse the fibers released from the chopped glass strands 10. The glass fiber slurry 18 is transferred from the constant level chest 22 to a head box 24 where the slurry 18 is deposited onto a moving screen or foraminous conveyor 26 to form a web 28 of enmeshed glass fibers. A binder 30 is then applied to the web 28 by a binder applicator 32, such as a curtain coater or spray applicator.

The binder 30 may be an acrylic binder, a styrene acrylonitrile binder, a styrene butadiene rubber binder, a urea formaldehyde binder, a polyacrylic binder, a urea-melamine binder, or mixtures thereof. A thermosetting urea formaldehyde binder is generally the most preferred binder due to its low cost. The urea formaldehyde binder may be modified with a styrene-butadiene rubber latex, an acrylic emulsion, or a styrene/acrylic emulsion to adjust the adhesion and mechanical properties of the binder. Non-exclusive examples of suitable urea formaldehyde resins include Casco-Resin FG-472X (available commercially by Hexion), GP-2928 and GP-2981 (available commercially from Georgia Pacific), and Dynea Prefere 2118-54 (available commercially from Dynea). Examples of acrylic emulsion binders include, but are not necessarily limited to, Rhoplex GL-618 and Rhoplex GL-720 (available commercially from Rohm & Haas) and Acronal DS 2396 (available commercially from BASF). A suitable example of a styrene-butadiene rubber latex includes 490NA from Dow Reichhold. The binder 30 may optionally contain conventional additives for the improvement of process and product performance such as dyes, oils, fillers, colorants, UV stabilizers, coupling agents (e.g., aminosilanes), lubricants, wetting agents, surfactants, and/or antistatic agents.

After the binder 30 has been applied to the web 28, a vacuum system 31 removes excess binder and white water from the web 28, and the excess binder and white water is passed through line 33 to a binder seal pit 36. In preferred embodiments, the excess binder and white water are fed into the binder seal pit 36 by gravitational forces. In addition, undiluted binder is pumped from a binder storage tank 34 to the binder seal pit 36 via a pumping device (not illustrated) where the undiluted binder is diluted to a desired concentration. The diluted binder in the binder seal pit 36 is then pumped by a pumping mechanism (not shown) through line 37 to the binder application device 32, thereby re-circulating the binder. The binder-coated web 38 is passed through one or more drying ovens 40 to remove any remaining water and cure the binder 30. The uncured binder functions to improve the strength of the wet-laid mat as it is transported from the head box 24 through the curing oven 40. The cured binder provides integrity to the glass mat 42. The formed non-woven, chopped strand mat 42 is an assembly of randomly oriented, dispersed, individual glass fibers. The non-woven chopped strand mat 42 may be rolled onto a take-up roll 44 for storage for later use, such as a reinforcement for a roofing shingle.

During the manufacture of the chopped strand mat, properties of the mat such as tear strength, tensile strength, hot wet tensile retention, caliper, loss on ignition (LOI), basis weight, and the degree of the cure of the binder are tested to ensure that the mat meets desired or regulated requirements and customer expectations. If the tear strength is determined to be unacceptable or below a predetermined value, the tear strength of the mat may be increased and/or adjusted by spiking the binder seal pit with one or more water-soluble polyols, such as, but not limited to, polyvinyl alcohol, glycerin, ethylene glycol, and butyl diol. As used herein, "spiking" is meant to indicate that an amount (e.g. a predetermined amount) of the component is added at one time to increase the concentration of that component for a limited period of time. The water-soluble polyol may have one, two, or three or more hydroxyl groups. Desirably, the polyol has two or more hydroxyl groups. The predetermined value is dependent upon the ultimate use of the chopped strand mat, and would be chosen by one of skill in the art.

The water-soluble polyol may be manually added or a computer assisted device (not shown) may be used to inject or otherwise supply a desired or predetermined amount of the polyol into the binder seal pit 36. It is to be appreciated that reference is made herein with respect to a preferred embodiment, polyvinyl alcohol, although any suitable water-soluble polyol may be used to spike the binder seal pit 36. Surprisingly, the addition of polyvinyl alcohol to the binder seal pit 36 during the manufacture of the glass mat causes an immediate or nearly immediate increase in the tear strength of the mat. Heretofore, it has not been known that the addition of a water soluble polyol such as polyvinyl alcohol improved the tear strength of a chopped strand glass mat. Also, it has been demonstrated that the addition of polyvinyl alcohol to the binder seal pit does not affect other properties of the chopped strand mat, such as the tensile strength.

The polyvinyl alcohol may be added to the binder seal pit 36 in an amount sufficient to achieve a concentration of the polyvinyl alcohol within the binder seal pit 36 from about 200 to about 4000 ppm, preferably from about 1000 to about 2000 ppm. Ultimately, the amount of water-soluble polyol that is added to the binder seal pit 36 is dependent upon the final product being formed. The addition of polyvinyl alcohol to the binder seal pit is particularly advantageous because only a small amount of polyvinyl alcohol is added to achieve a desired improvement in tear strength. It is to be appreciated that the polyvinyl alcohol, or other water soluble polyol, is not part of the binder. The water soluble polyol is added to the binder seal pit as needed to improve or adjust the tear strength of the chopped strand mat in response to current manufacturing conditions. This ability to monitor and adjust the tear strength of the glass mat in-line creates manufacturing flexibility.

Alternatively, the binder seal pit 36 or the white water chest 16 can be spiked with one or more cationic dispersants to improve the tear strength of the mat. The cationic dispersant may be water-soluble and/or water-dispersible. As with the water-soluble polyol described above, the cationic dispersant can be manually added or automatically added with the aid of a computer monitored device (not illustrated). The addition of a cationic dispersant to the white water in the white water chest is simple from a commercial standpoint and has been demonstrated not to have a negative impact on other glass mat properties such as tensile strength, hot wet tensile retention, and mat formation. Spiking the binder seal pit with one or more cationic dispersants requires the addition of a smaller amount of dispersants than spiking the white water chest (e.g., about 88 grams vs. about 15 lbs of added cationic dispersant), and thus may provide an economic advantage and lower costs. Non-limiting examples of cationic dispersants that may be added to the white water to improve the tear strength of the chopped strand mat include tallow amine dispersants such as Nalco NM159 (Ondeo Nalco Company), ethoxylated alkylamine dispersants such as Nalco 8493 (Ondeo Nalco Company), fatty acid esters, polyethylene glycol, cationic quaternary amine, amine oxides, and/or a polyethyoxylated derivative of an amide condensated fatty acid. The cationic dispersant(s) may be added to the binder seal pit in an amount sufficient to achieve a concentration of the cationic dispersant in the binder seal pit from about 200 to about 4000 ppm, preferably from about 1000 to about 2000 ppm. Alternatively, the cationic dispersant(s) may be added to the white water chest in an amount sufficient to achieve a cationic dispersion concentration in the white water chest from about 200 to about 2000 ppm, preferably from about 800 to about 1600 ppm.

There are numerous advantages provided by the methods of the present invention. For instance, the addition of polyvinyl alcohol or a cationic dispersant to the binder seal pit results in an immediate or nearly immediate improvement of the tear strength of the chopped strand mat. Additionally, the polyvinyl alcohol or cationic dispersant(s) may be added at any time during the manufacturing process as needed. Thus, the methods provide for an on-going, in-line adjustment (e.g., improvement) of the tear strength of the chopped strand mat. Moreover, the tear strength of the mat can be increased as the mat is being formed in response to current manufacturing conditions by the addition of a water soluble polyol, such as polyvinyl alcohol, or a cationic dispersant. In addition, the polyvinyl alcohol and the cationic dispersant can be utilized to improve the tear strength of a chopped strand mat regardless of the type of binder or the white water components.

Having generally described this invention, a further understanding can be obtained by reference to certain specific examples illustrated below which are provided for purposes of illustration only and are not intended to be all inclusive or limiting unless otherwise specified.

EXAMPLES

Example 1

Spiking the Binder Seal Pit with a Cationic Dispersant or Polyvinyl Alcohol

Wet chopped glass strands having a length of 1.375 inches were obtained and fed to a sheet former to form a chopped strand glass mat. Prior to spiking the binder seal pit with a cationic dispersant, the initial tear strength of the chopped strand mat was determined and recorded. To ensure accurate results, fifteen separate measurements of the initial tear strengths were made. Once the initial tear strengths were recorded, 89.0 grams of Nalco NM159, a tallow amine ethoxylate dispersant available from Ondeo Nalco Company, was added to the binder seal pit during the formation of the chopped strand mat. The total volume of the binder seal pit was 8.0 gallons. The addition of 89.0 grams of the cationic dispersant increased the cationic dispersant concentration in the binder seal pit from about 200 ppm to about 1300 ppm. The chopped strand mat formed utilizing the spiked binder solution was tested three times to determine the tear strength, and the spiked tear strengths were recorded.

The binder seal pit was then cleaned to remove the added cationic dispersant and return the binder seal pit its original condition. The sheet former was started and 67 grams of polyvinyl alcohol (Excelsize 159 available from Jain Chen Limited) was added to the binder seal pit. The addition of the polyvinyl alcohol to the binder seal pit resulted in an increase in the concentration of the polyvinyl alcohol in the binder seal pit from about 200 ppm to about 1200 ppm. The tear strength of the chopped strand mat formed after the addition of the polyvinyl alcohol was measured three separate times and the tear strengths were recorded.

The data for the tear strengths for both the spiking with the cationic dispersant and the polyvinyl alcohol was entered into Minitab® and a box-plot was generated. The results of the experiment are set forth in FIG. 2.

Figure 2:
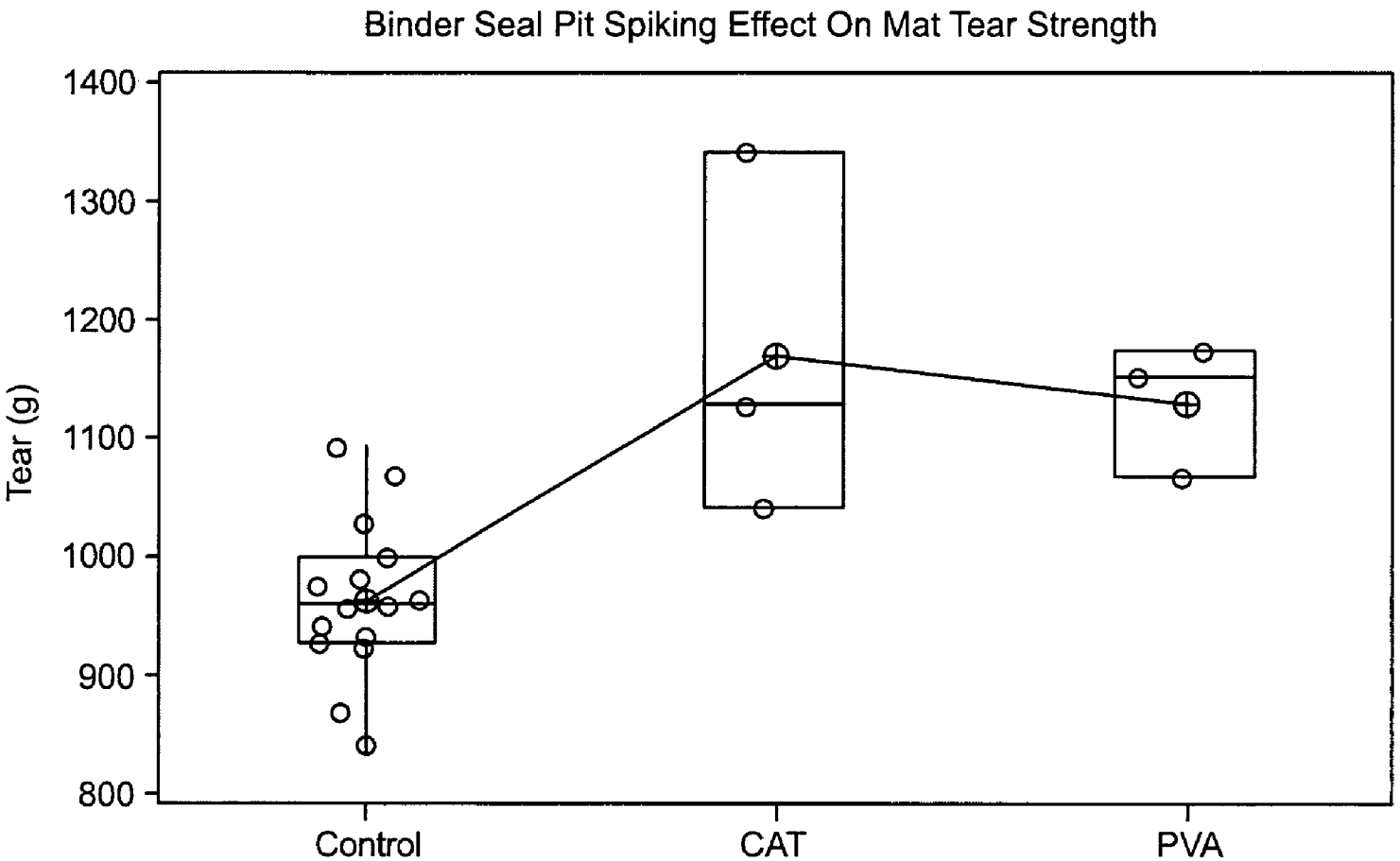
FIG. 2 is a graphical illustration of the tear strengths of chopped strand glass mats before and after spiking the binder seal pit with a cationic dispersant or polyvinyl alcohol.
Figure 4:
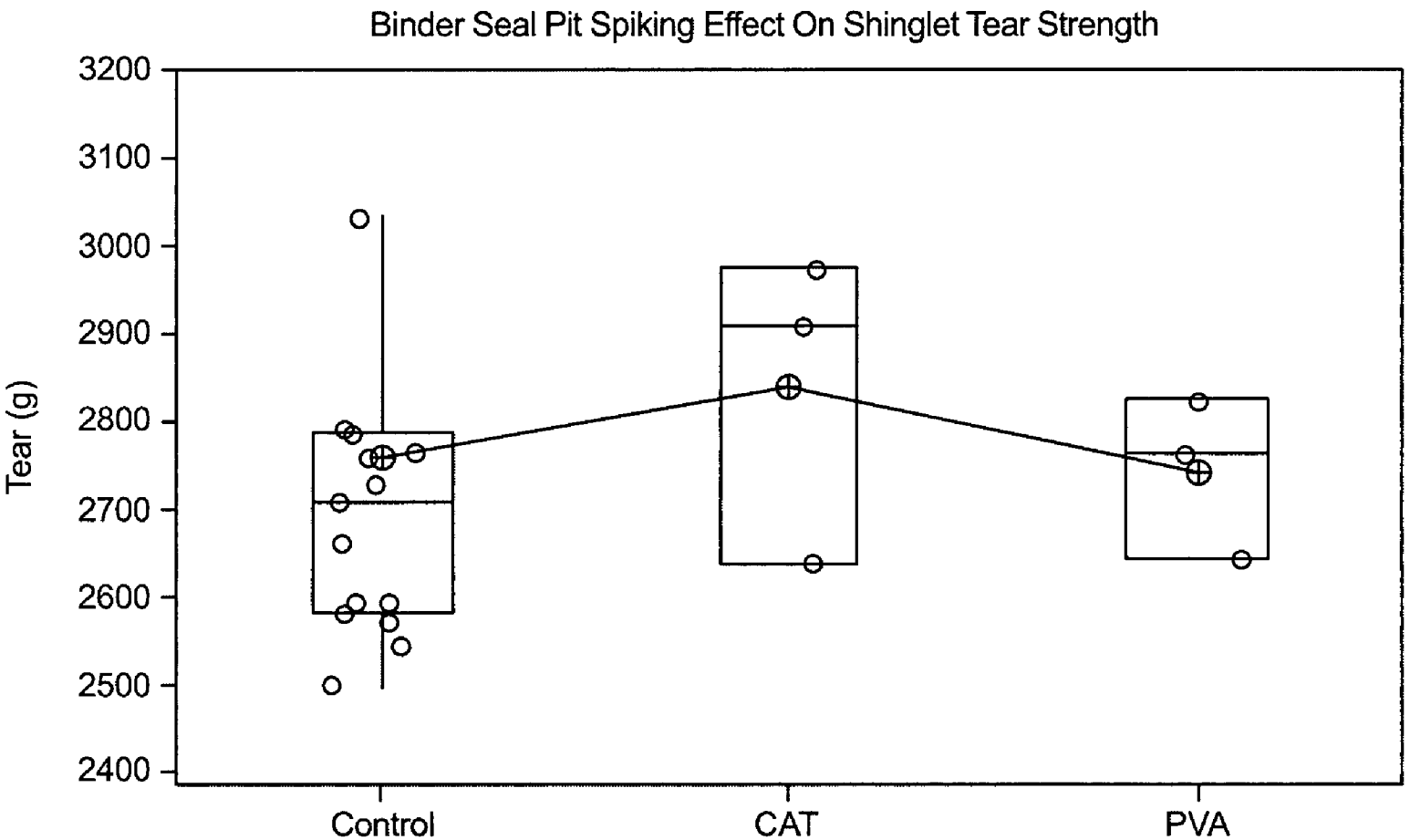
FIG. 4 is a graphical illustration of the tear strengths of shinglets formed from chopped strand glass mats before and after spiking the binder seal pit with a cationic dispersant or polyvinyl alcohol.
Figure 5:
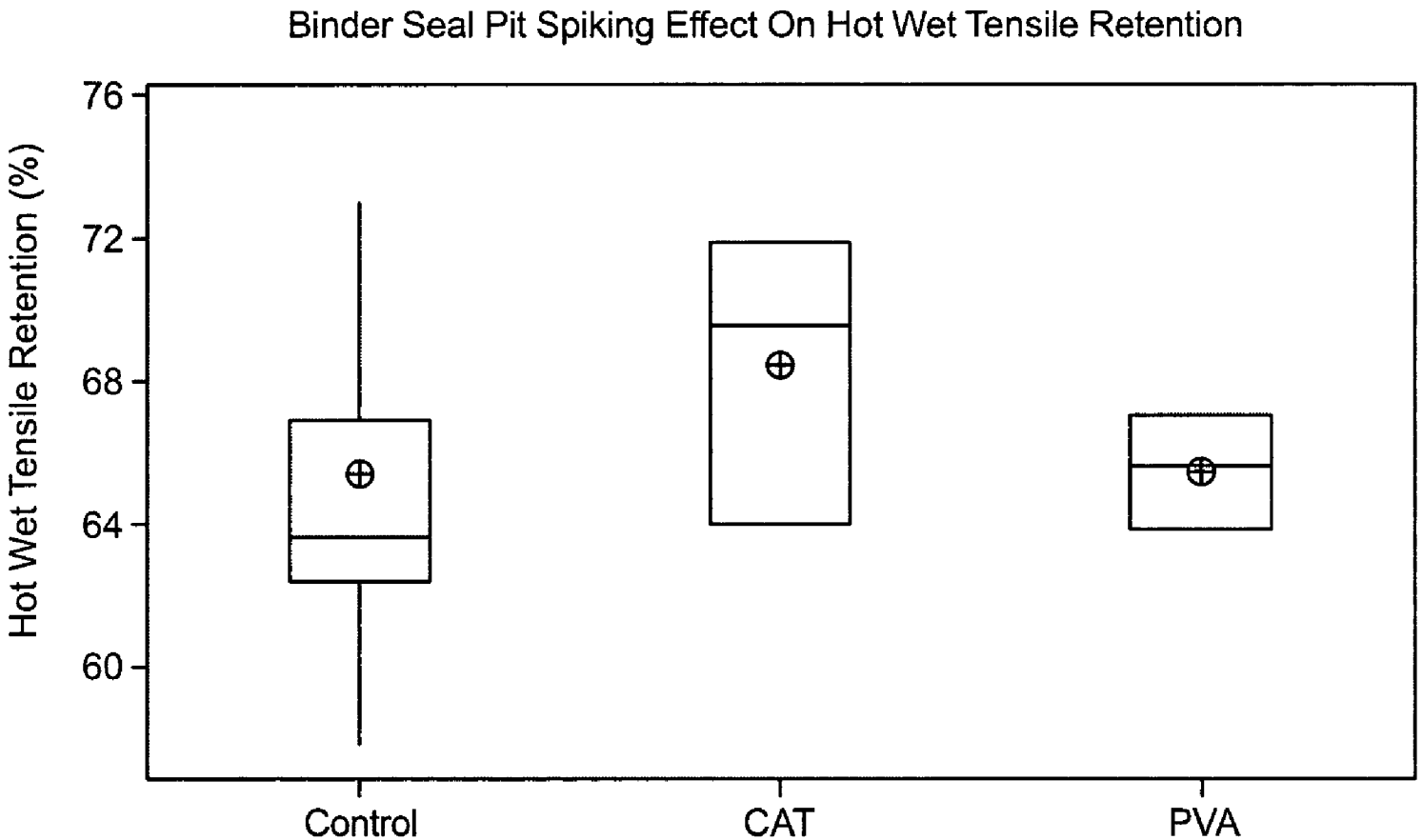
FIG. 5 is a graphical illustration of the hot wet tensile retentions of chopped strand mats before and after spiking the binder seal pit with a cationic dispersant or polyvinyl alcohol.

As shown in FIG. 2, there was a marked increase in the tear strength of the chopped strand mat when the binder seal pit was spiked with a cationic dispersant. In particular, spiking the binder seal pit with a cationic dispersant improved the tear strength of the chopped strand mat from an average of about 950 grams (i.e., initial tear strength) to about 1150 grams. Additionally, it was demonstrated that the tear strength of a shinglet formed from the formed the chopped strand glass mat increased from 1700 grams to 2850 grams after spiking the binder seal pit with the cationic dispersant. (See FIG. 4). Further, FIG. 5 demonstrates that the addition of the cationic dispersant to the binder seal pit improved the hot wet tensile retention from 64% to 68%.

Figure 6:
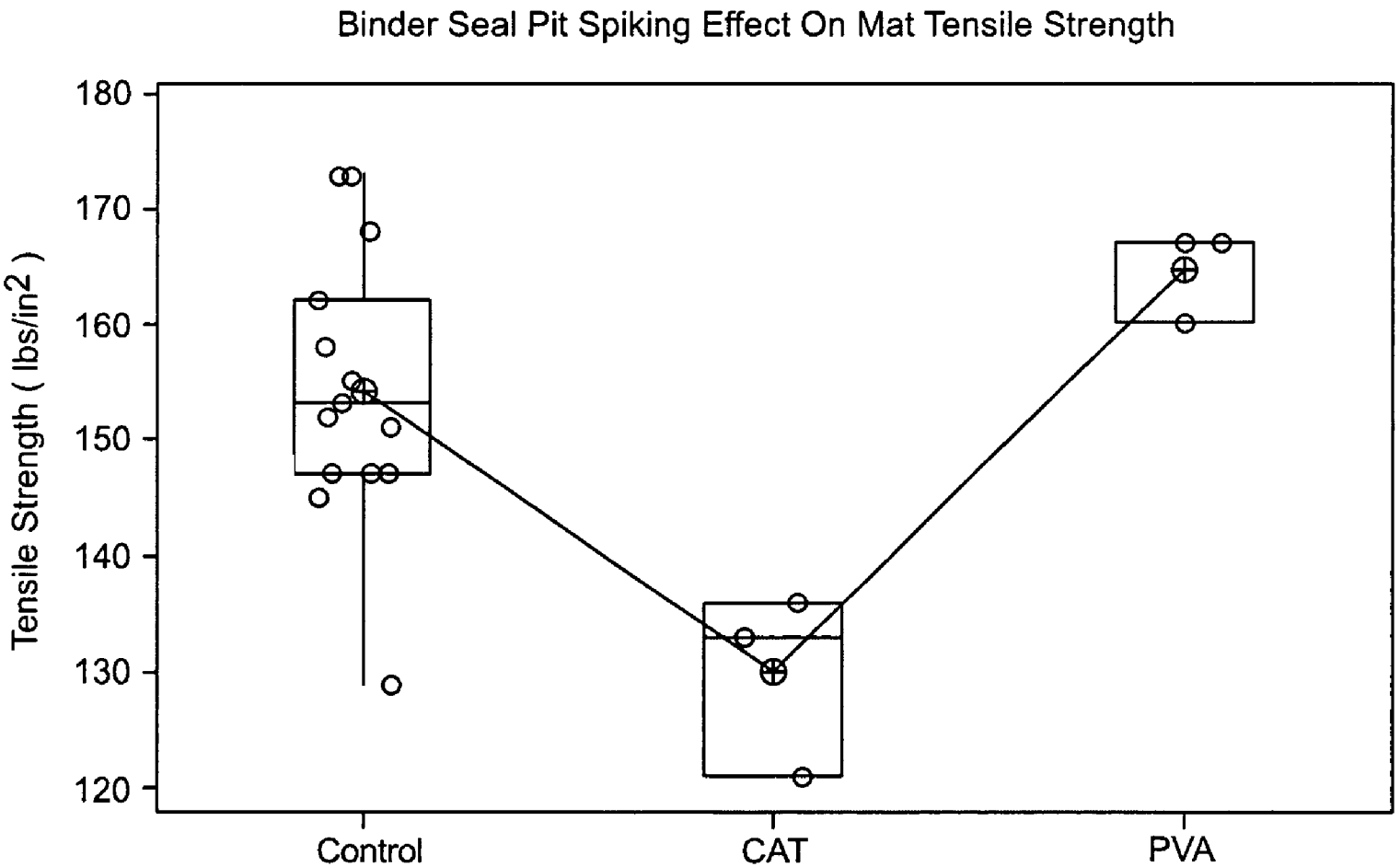
FIG. 6 is a graphical illustration of the tensile strengths of chopped strand mats before and after spiking the binder seal pit with a cationic dispersant or polyvinyl alcohol.

The box-plot of FIG. 2 also shows that spiking the binder seal pit with polyvinyl alcohol resulted in a significant increase in the tear strength of the chopped strand mat. Specifically, the average tear strength of the chopped strand mat rose from about 950 grams (i.e., initial tear strength) to about 1150 grams. Additionally, it was determined that spiking the binder seal pit with polyvinyl alcohol did not negatively impact the shinglet tear strength, the mat hot wet tensile retention, or the mat tensile strength. (See FIGS. 4-6 respectively). In addition, it was noted that the tear strength of the mat improved almost instantaneously after the addition of polyvinyl alcohol.

Comparing the results of spiking the binder seal pit with a cationic dispersant versus polyvinyl alcohol, it can be concluded that the tear strengths of the mat when spiked with either a cationic dispersant or with polyvinyl alcohol were very similar. It can also be concluded that spiking the binder seal pit with either polyvinyl alcohol or a cationic dispersant will increase the tear strength of the chopped strand glass mat.

Example 2

Spiking the White Water Chest with a Cationic Dispersant

Wet chopped glass strands having a length of 1.375 inches were obtained and fed to a sheet former to form a chopped strand glass mat. The initial tear strength of the chopped strand mat was determined and recorded. 15 lbs of Nalco NM159, a tallow amine ethoxylate dispersant available from Ondeo Nalco Company, was added to the white water chest 5 lbs at a time followed by circulation of the white water. The addition of the cationic dispersant caused an increase in the concentration of the cationic dispersant in the white water chest from about 300-400 ppm to about 1300 ppm. A chopped strand mat was formed utilizing the spiked white water. Three separate tear strengths were measured and recorded. The data was entered into Minitab® and a box-plot was generated. The results of the experiment are set forth in FIG. 3.

Figure 3:
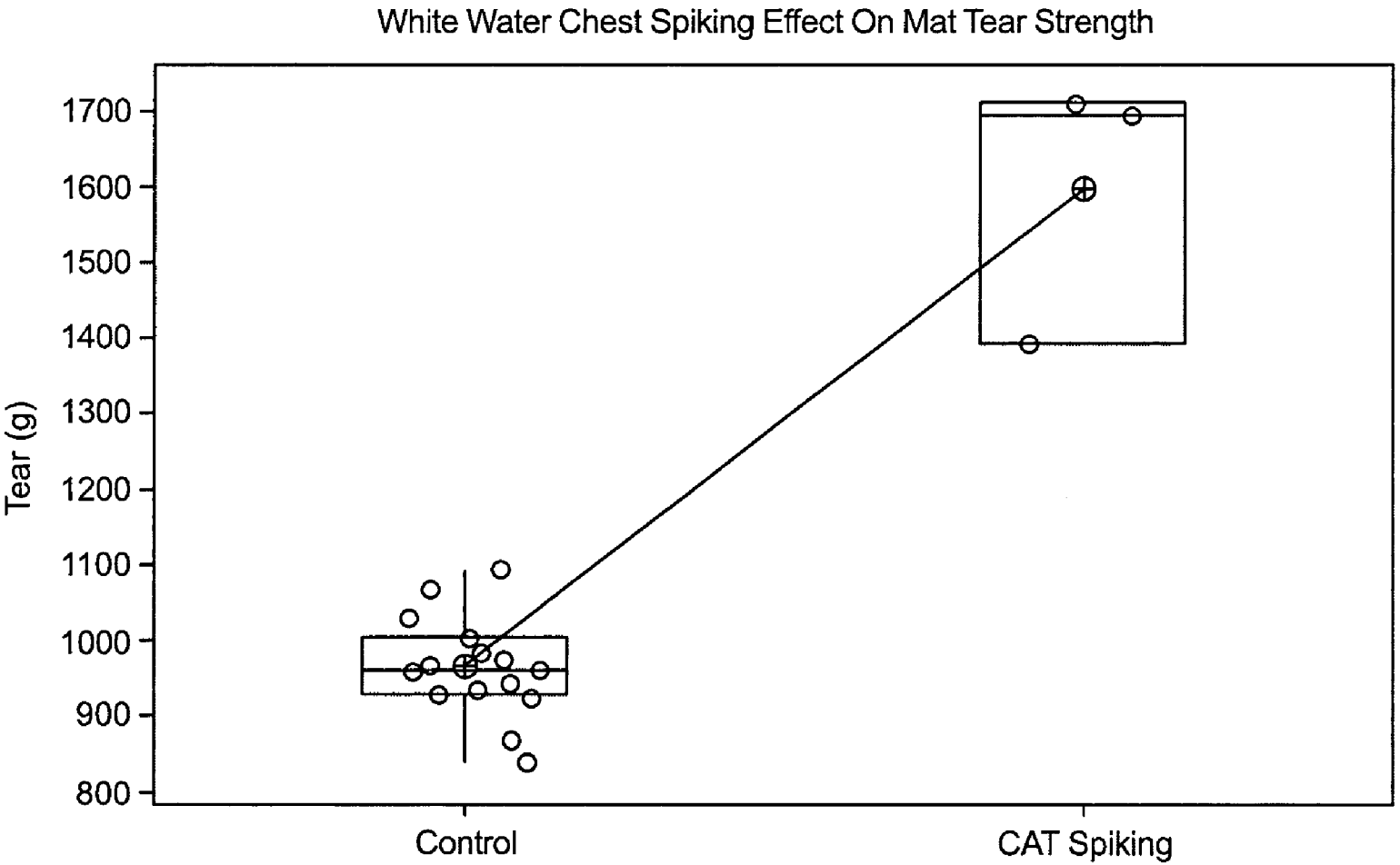
FIG. 3 is a graphical illustration of the tear strengths of chopped strand glass mats before and after spiking the white water chest with a cationic dispersant.
Figure 7:
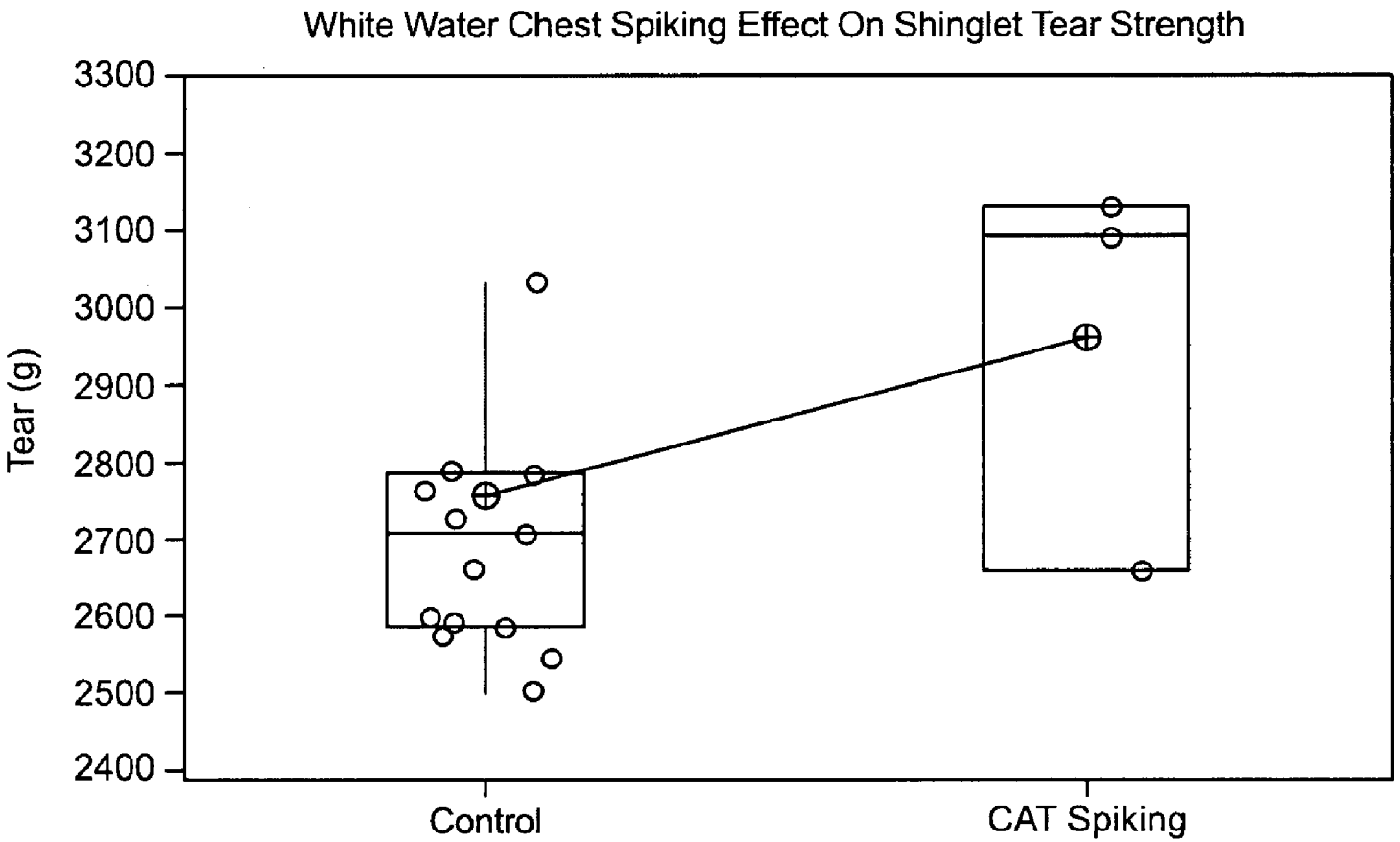
FIG. 7 is a graphical illustration of the tear strengths of shinglets formed from chopped strand glass mats before and after spiking the white water chest with a cationic dispersant.
Figure 8:
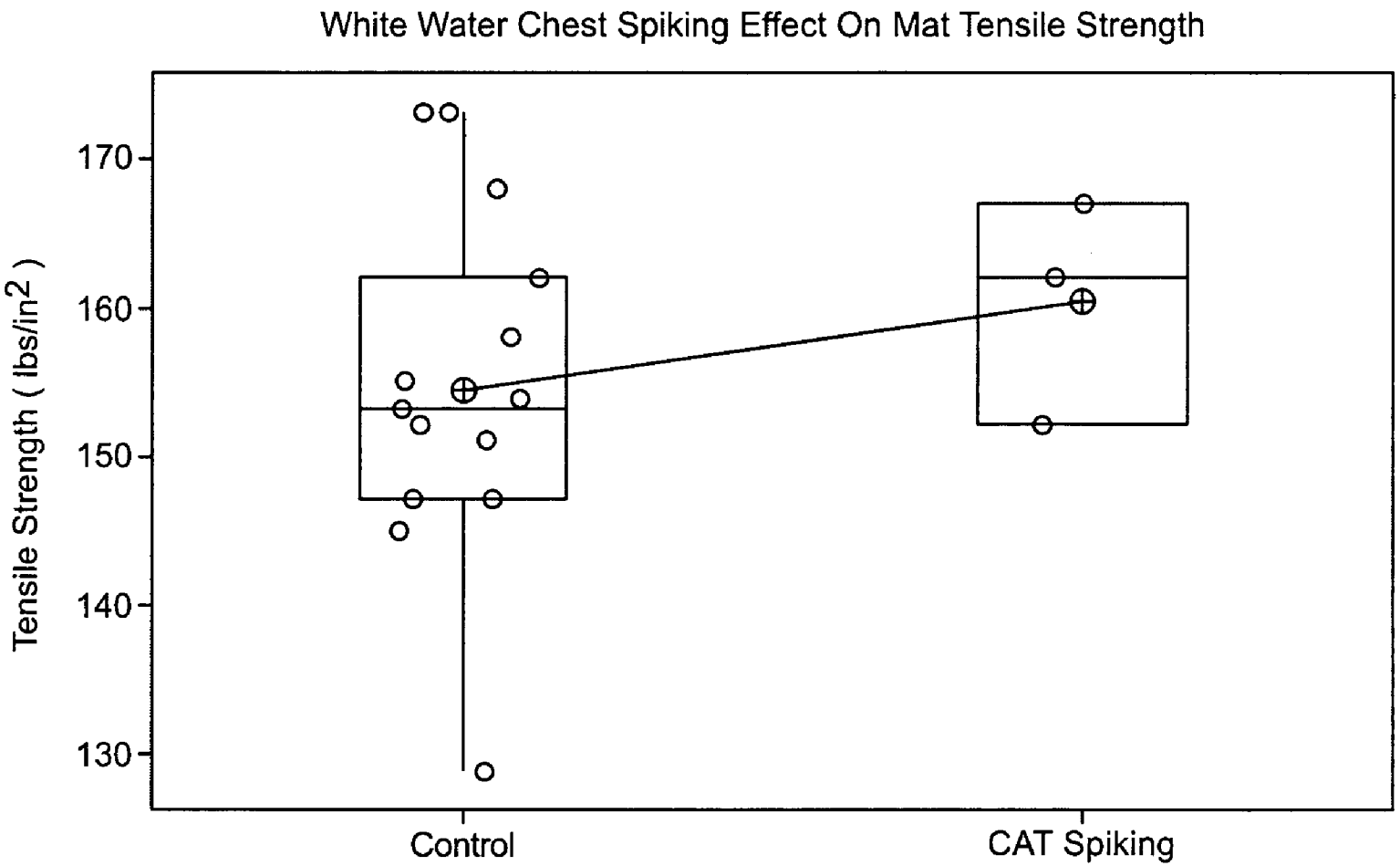
FIG. 8 is a graphical illustration of the tensile strengths of chopped strand mats before and after spiking the white water chest with a cationic dispersant.
Figure 9:
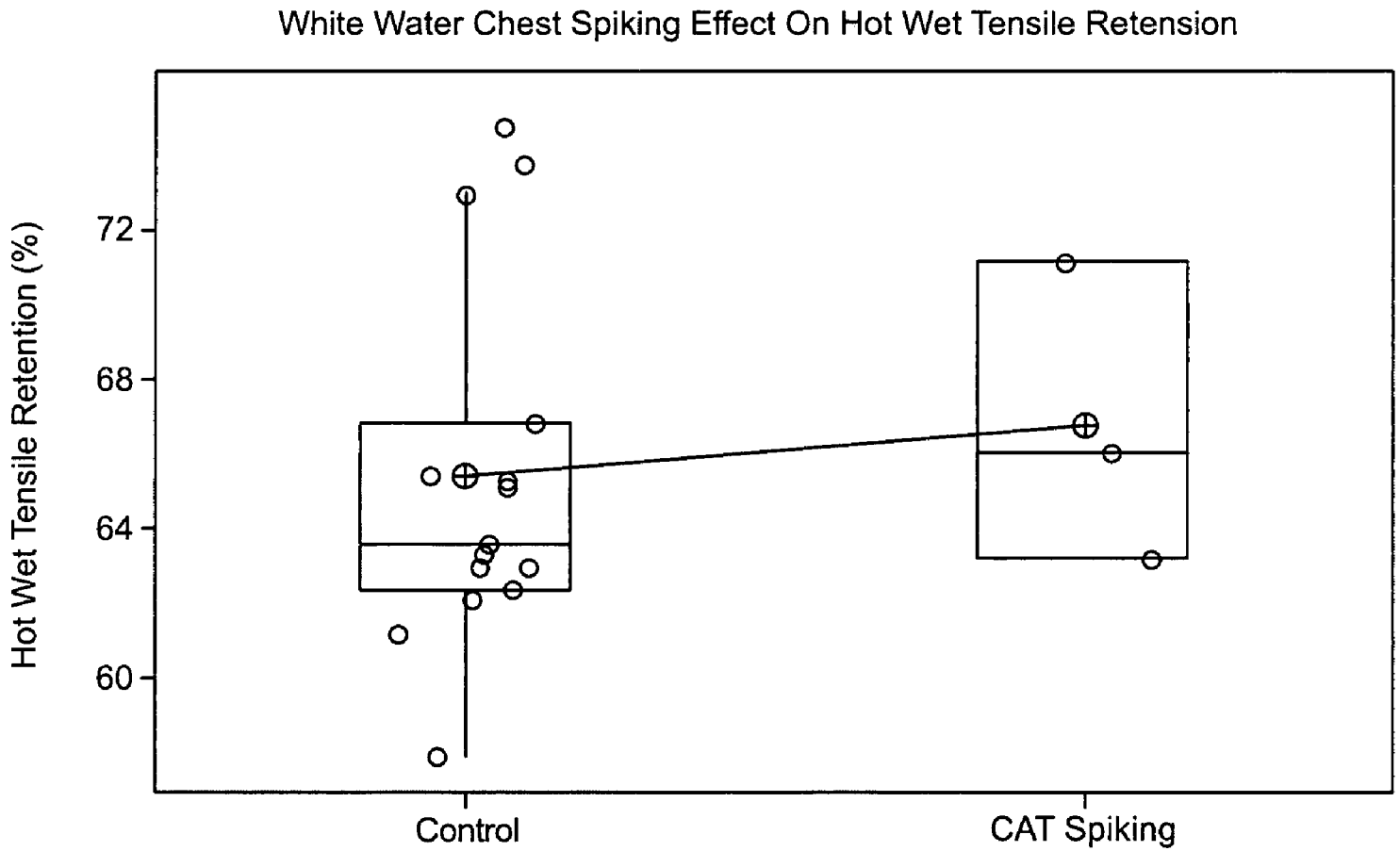
FIG. 9 is a graphical illustration of the hot wet tensile retention of chopped strand mats before and after spiking the white water chest with a cationic dispersant.

As can be seen in FIG. 3, the tear strength of the chopped strand glass mat increased from about 950 grams to about 1550 grams after the addition of the cationic dispersant to the white water chest. Thus, it can be concluded that the addition of a cationic dispersant to the white water chest improved the tear strength of the chopped strand glass mat. It was also demonstrated that the tear strength of a shinglet formed from the chopped strand glass mat increased from 2700 grams to 2900 grams after spiking the white water chest with the cationic dispersant. (See FIG. 7). Additionally, FIGS. 8 and 9 illustrate that the tensile strength of the mat and the hot wet tensile retention of the mat slightly improved after the addition of the cationic dispersant to the white water chest.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A method of improving the tear strength of chopped strand mats in-line comprising:

forming a chopped strand glass mat by a wet-laid process including a binder seal pit; and spiking said binder seal pit with a water-soluble polyol during said wet-laid process to raise said tear strength of said chopped strand mat.

2. The method of claim 1, wherein said water-soluble polyol is at least one member selected from polyvinyl alcohol, glycerin, ethylene glycol and butyl diol.

3. The method of claim 1, wherein said binder seal pit is spiked with a sufficient amount of said water-soluble polyol to achieve a concentration of said water-soluble polyol within said binder seal pit from about 1000 to about 2000 ppm.

4. The method of claim 3, wherein said at least one water-soluble polymer is polyvinyl alcohol.

5. The method of claim 4, wherein said polyvinyl alcohol improves said tear strength of said chopped strand mat without the addition of other chemicals or additives.

6. The method of claim 4, wherein said polyvinyl alcohol improves said tear strength of said chopped strand mat without detrimentally affecting the tensile strength of said chopped strand mat.

7. The method of claim 3, wherein said wet-laid process includes:

depositing a chopped fiber slurry on a conveyor to form a web of enmeshed fibers;

applying a binder to said web;

removing water from web; and curing said binder to form said chopped strand glass mat.

8. A method of adjusting the tear strength of a chopped strand mat during the manufacture of said mat comprising:

determining an initial tear strength of a chopped strand mat being formed in a wet-laid process including a binder seal pit;

adding one or more cationic dispersants to said binder seal pit if said initial tear strength is below a predetermined value.

9. The method of claim 8, wherein said one or more cationic dispersants is selected from tallow amine dispersants, ethoxylated alkylamine dispersants, fatty acid esters, polyethylene glycol, cationic quaternary amine, amine oxides and a polyethyoxylated derivative of an amide condensated fatty acid.

10. The method of claim 8, wherein said one or more cationic dispersants is added in an amount to achieve a concentration of said cationic dispersant within said binder seal pit from about 1000 to about 2000 ppm.

11. The method of claim 10, wherein said one or more cationic dispersants is a tallow amine dispersant.

12. The method of claim 8, wherein said one or more cationic dispersants is water-soluble, water dispersible, or a combination thereof.

13. The method of claim 8, wherein said one or more cationic dispersants improves said tear strength of said chopped strand mat without the addition of other chemicals or additives.

14. The method of claim 8, wherein said wet-laid process includes:

depositing a chopped fiber slurry on a conveying apparatus to form a web of enmeshed fibers;

applying a binder to said web;

removing water from said chopped fiber slurry; and curing said binder to form said chopped strand glass mat.

15. A method for improving the tear strength of a chopped strand mat in-line comprising:

forming a chopped fiber slurry in a white water chest;

depositing said chopped fiber slurry on a conveying apparatus to form a web of enmeshed fibers;

applying a binder to said web;

removing excess water from said web;

curing said binder to form a chopped strand mat;

determining an initial tear strength of said chopped strand mat; and spiking said white water chest with at least one cationic dispersant if said initial tear strength is below a predetermined value.

16. The method of claim 15, wherein said at least one cationic dispersant is selected from tallow amine dispersants, ethoxylated alkylamine dispersants, fatty acid esters, polyethylene glycol, cationic quaternary amine, amine oxides and a polyethyoxylated-derivative of an amide condensated fatty acid.

17. The method of claim 16, said at least one cationic dispersant is added in an amount to achieve a concentration of said at least one cationic dispersant within said white water chest from about 800 to about 1600 ppm.

18. The method of claim 16, wherein said addition of said at least one cationic dispersant does not have a negative impact on the tensile strength of said chopped strand mat, hot wet tensile retention of said chopped strand mat, and mat formation.

19. The method of claim 16, wherein said addition of at least one cationic dispersant improves said tear strength of said chopped strand mat without the addition of other chemicals or additives.

20. The method of claim 16, wherein said at least one cationic dispersant is a tallow amine dispersant.

* * * * *